United States Patent [19]

Suiter

[11] 4,432,436

[45] Feb. 21, 1984

[54] ADJUSTABLE TRANSOM BRACKETS AND COMPACT SELF-STORING BOAT LADDER

[76] Inventor: Glen H. Suiter, R.R. 1, Le Claire, Iowa 52758

[21] Appl. No.: 422,114

[22] Filed: Sep. 23, 1982

[51] Int. Cl.[3] ..... E06C 5/04; B63B 27/14

[52] U.S. Cl. ..... 182/97; 182/91; 182/100; 182/189; 280/166; 114/343

[58] Field of Search ..... 182/91, 97, 100, 189, 182/95, 96; 280/166; 114/343

[56] References Cited

U.S. PATENT DOCUMENTS

| | | | |
|---|---|---|---|
| 197,766 | 12/1877 | Crawford . | |
| 945,280 | 1/1910 | Lindberg | 248/242 |
| 1,953,298 | 4/1934 | Goodwin | 182/91 |
| 2,924,291 | 1/1969 | Tunstead | 182/156 |
| 3,019,851 | 2/1962 | Doss | 182/189 |
| 3,285,367 | 11/1966 | Brodie | 182/97 |
| 3,825,097 | 7/1974 | Owen | 182/91 |
| 3,869,742 | 3/1975 | Gale et al. | 182/189 |
| 3,892,290 | 7/1975 | Lang | 182/163 |
| 3,980,157 | 9/1976 | Wrigley | 182/97 |
| 4,146,941 | 4/1979 | Haslam | 182/91 |
| 4,198,070 | 4/1980 | Weiler | 182/91 |
| 4,355,701 | 10/1982 | Nicholson | 182/97 |

*Primary Examiner*—R. P. Machado

*Attorney, Agent, or Firm*—Henderson & Sturm

[57] ABSTRACT

A single post ladder for ascending from the water over the transom of small boats and a bracket that is permanently attached near the bottom of the transom. The bracket holds the shaft below and perpendicular to the bottom of the transom when in down position and also locks the shaft in vertical position above the bottom and along the plane of the transom for storage. Hinged steps extend approximately perpendicular to the shaft parallel to the transom when the shaft is in down position and lay along side the shaft when it is rotated to the up or storage position.

2 Claims, 10 Drawing Figures

FIG. 1
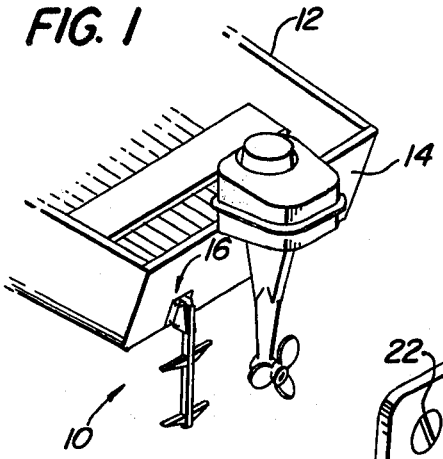
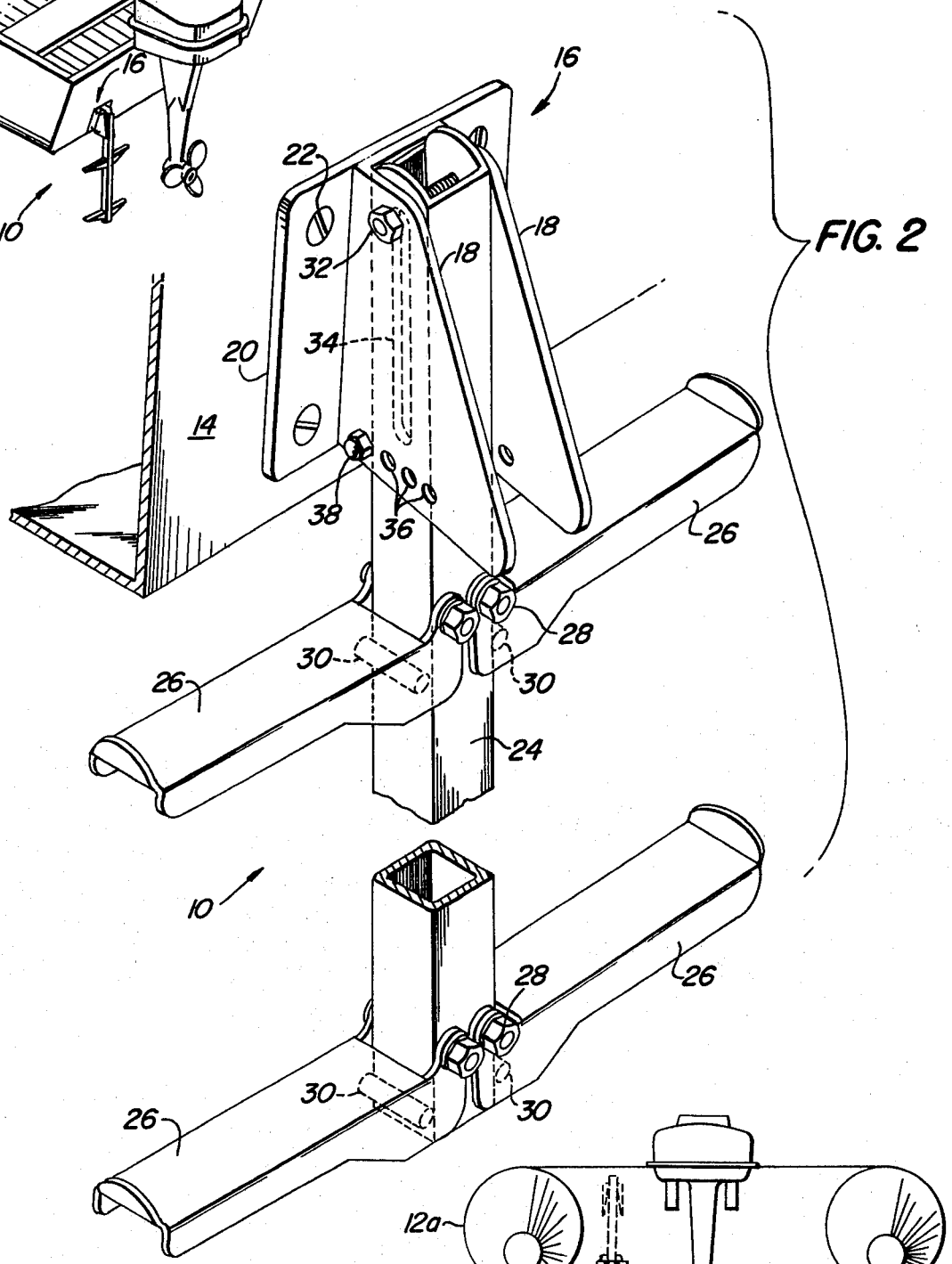
FIG. 2
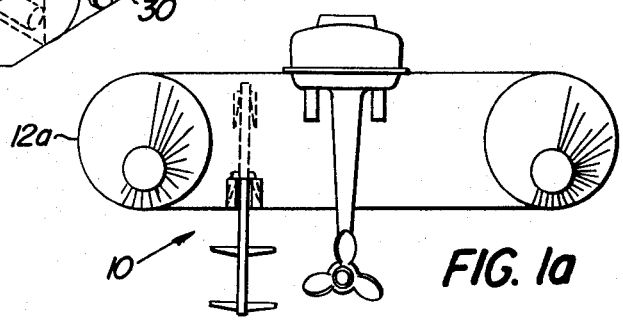
FIG. 1a

FIG. 5
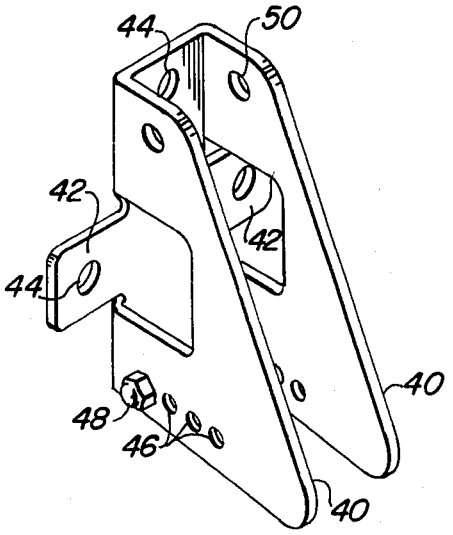
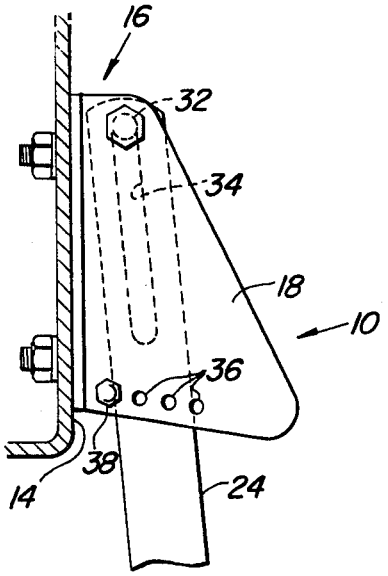
FIG. 4
FIG. 3
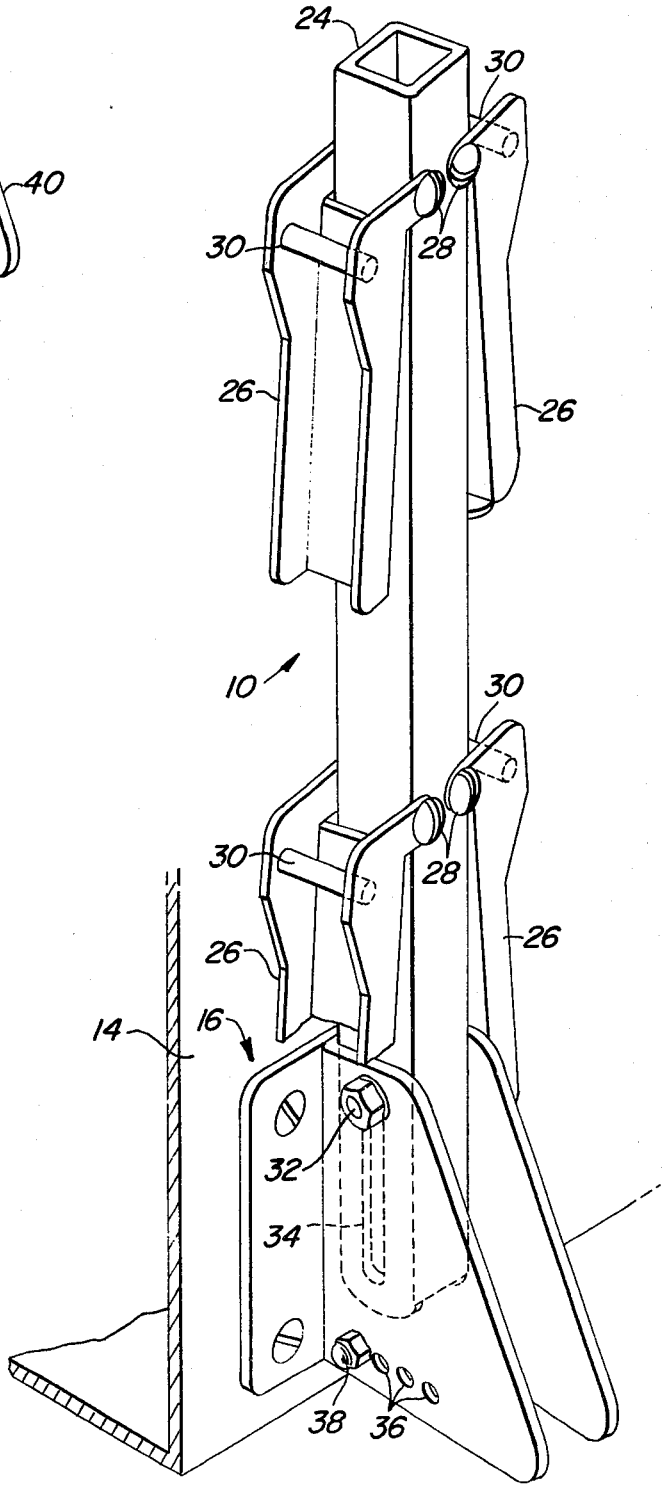

ADJUSTABLE TRANSOM BRACKETS AND COMPACT SELF-STORING BOAT LADDER

BACKGROUND OF THE INVENTION

Ladders for small boats, such as inflatables, dinghies, tenders, Jon boats, etc., are known as aids to a person in the water in climbing into the boat. A permanently mounted transom ladder is preferred because it is available when needed and offers the greatest stability and minimizes the chances of capsizing the craft.

Many small boats are fitted with ladders permanently attached to their transoms. These ladders usually have two vertical posts with rungs attached between them. Some hinge and rotate down into the water when in use and rotate up and out of the water for storage. Twelve or more inches of width along the transom is required for installation.

Similar two-post ladders are attachable to the side of a boat. The upper posts on some are curved to loop over the gunwale. Such ladders require legs that protrude against the side of the boat to hold them in near vertical position and will not work on pontoon or inflatable boats or boats with minimum freeboard as the bottom of the ladder swings under the boat when weight is applied. The same difficulty arises when using a rope or Jacobs ladder.

Removable ladders must be stored when the boat is underway or they may be lost. Such ladders are dangerous as they may not be accessible to a lone boater in the water.

SUMMARY OF THE INVENTION

The important features of this invention are as follows: The bracket that holds the single post ladder attaches permanently to the lower transom of a small boat. When in vertical or storage position, the ladder is less than four inches wide. When in down or use position, opposed hinged steps fold out from the shaft and the ladder becomes approximately nine inches wide. A locking device is designed into the bracket and post to hold the ladder in vertical or storage position without the use of a fastener. When in storage position, no portion of the bracket or ladder extends below the bottom of the transom. Nor does the ladder extend significantly above the top of the transom. The bracket has an adjustment to compensate for the rake of the transom so the shaft is perpendicular to the plane of the surface of the water when in down or use position. Steps that are open to the outside accommodate swimmers and divers with fins on their feet. Steps are designed to extend approximately 80° from the vertical post. Steps also have stops at the ends. Both of these features tend to reduce transverse sliding of the feet of the person ascending the ladder. The ladder can be easily rotated from storage to boarding position by a person alone in the water without the use of tools or removal of fasteners. The ladder is small and light in weight.

DESCRIPTION OF THE DRAWINGS

FIG. 1 is a small-scale, fragmentary perspective showing the mounting of the ladder on the transom of a typical small boat.

FIG. 1A is a rear elevation of an inflatable boat with the improved ladder mounted to the transom thereof.

FIG. 2 is an enlarged perspective of one form of ladder shown in its down position, a portion of the ladder being omitted to shorten the view.

FIG. 3 is a perspective showing the ladder of FIG. 2 in its up position.

FIG. 4 is an elevation, partly in section, of an upper part of the structure showing particularly the means for adjusting the angle of the ladder to the transom so as to accommodate the rake angle of the latter.

FIG. 5 is a perspective showing a modified form of mounting bracket.

DETAILED DESCRIPTION OF PREFERRED FORMS OF THE INVENTION

Figure 6:
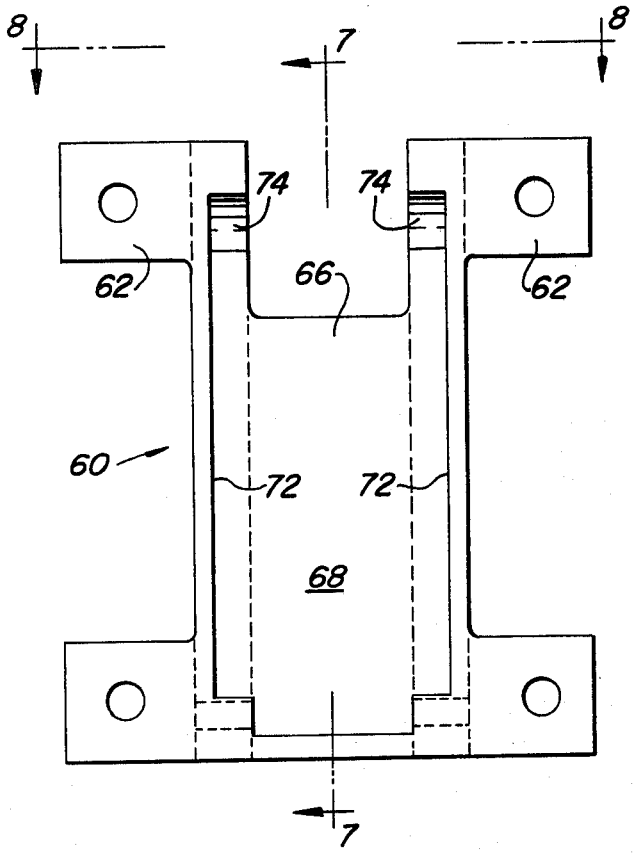
FIG. 6 is an elevation of a further form of bracket.

A ladder representative of subject invention is designated in its entirety by the numeral 10 and is shown in FIG. 1 especially as being attached to a typical small boat 12 having a transom 14 to which the ladder is attached by a bracket 16.

The bracket of FIGS. 1-4 has a pair of support flanges 18 spaced apart laterally and projecting rearwardly in upright fore-and-aft planes relative to the transom. These flanges are preferably integral with a face flange 20 by means of which the bracket is secured to the transom in any suitable manner, such as by bolts 22. Although the flanges are shown as triangular, they may assume any shape consistent with strength and function. The ladder is made up of an elongated post 24 and a plurality of steps 26. The post may be of any suitable design and material, preferably tubular and made of strong lightweight metal. Each step is pivoted to the post at 28 for folding from a laterally outwardly extending position (FIG. 2) to a position folded closely alongside the post (FIG. 3). Each step has one-way stop means 30 to limit the down position of the step while permitting the folded position. As will appear later, the steps are biased by their own weight to swing automatically between their FIG. 2 and FIG. 3 positions as the post is inverted between its up and down positions.

As will be seen from a comparison of FIGS. 2 and 3, the ladder in its down position depends from the bracket and into the water, the steps folding out and being thus easily accessible to a person in the water who wishes to climb into the boat. In FIG. 3, the ladder is clear of the water and the steps are folded in. The upper end portion of the post is received between the bracket flanges 18 and is swingably mounted on the bracket by means of a cross pivot 32 in the flanges and a slot 34 in the post. When the post is in its down position, the cross pivot is at the upper end of the slot. In order to accommodate the rake angle of the transom, the flanges 18 have a plurality of apertures 36 at lower portions thereof and a stop pin 38 may be passed crosswise between a selected pair of apertures to provide a stop limiting forward swinging of the post while in its down position, it being preferred that the post depend substantially perpendicularly into the water and at least not so far forwardly as to swing beneath the transom.

The upper end of the post is somewhat rounded so as to enable pivoting of the post about the pivot pin 32, which is achieved by swinging the post rearwardly and then upwardly to an inverted position followed by allowing the post to slide downwardly on the pivot pin via the slot 34, the pivot and slot functioning thus as a track and follower. When the post is slid downwardly as aforesaid it cannot be immediately swung outwardly and rearwardly because the post portion that now depends below the cross pivot 32 is confined by the cross pivot and that portión of the bracket that spans the flanges 18, thus affording pocket means for retaining the post in its storage position. Of course, as the post is inverted to this position, the steps automatically fold alongside the post (FIG. 3). Before the ladder can be moved again to its down position, it must be raised via the slot and cross pivot until it is free to swing rearwardly. When the ladder is in its up position, it is compactly and neatly stored and takes up only a relatively small space. The in-folded steps add to this feature.

The bracket shown in FIG. 5 has all the attributes of that just described, including support flanges 40, a pair of mounting ears 42, mounting holes 44 in these ears as well as in a back portion of the bracket between the flanges 40. The flanges have apertures 46 in their lower portions like those described at 26 for receiving a stop pin 48. The flanges also have a pair of alined holes 50 at their upper ends for receiving a cross pivot for pivotally mounting the post 24.

Figure 7:
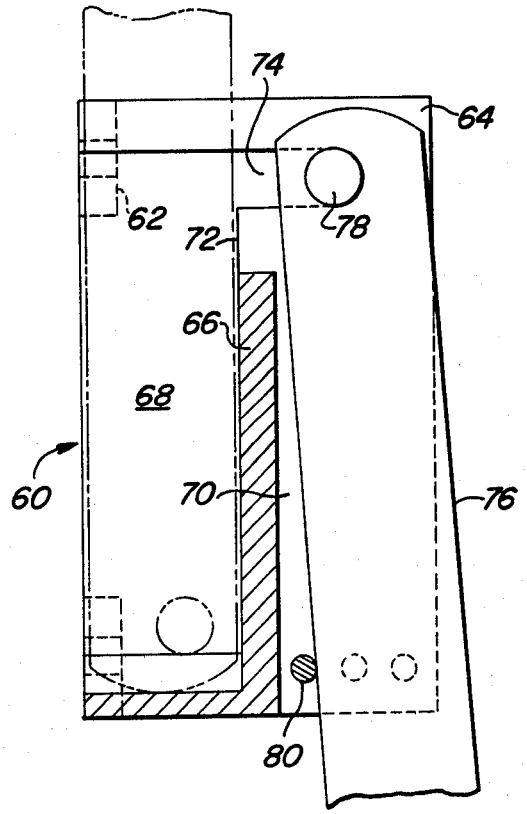
FIG. 7 is a section as seen on the line 7—7 of FIG. 6.
Figure 8:
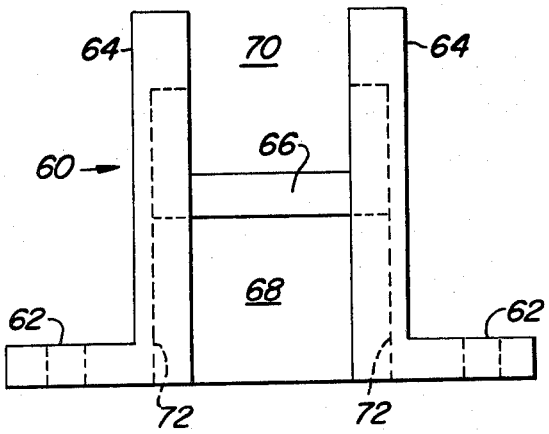
FIG. 8 is a top plan view of the bracket of FIGS. 6 and 7.
Figure 9:
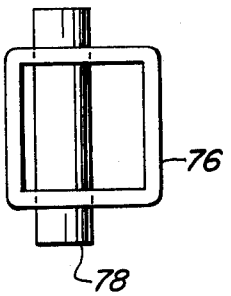
FIG. 9 is a top plan of the form of ladder post used with aforesaid bracket.

The modified bracket and post design shown in FIGS. 6 through 9 has the functional characteristics of those already described. The modified bracket is designated as a whole by the numeral 60 and may be formed as a lightweight metal casting having apertured mounting ears 62 and integral support walls 64 similar in function to the flanges 18 on the previously described bracket. As best seen in FIG. 7, an upright cross wall 66 extends between the side walls 64 and gives the bracket a forward pocket means 68 that opens at its top. The cross wall further gives the bracket a rearward compartment that opens rearwardly as well as upwardly and downwardly. The interiors of the side walls 64 provide the opposite sides of the pocket means with upright parts of symmetrical track means 72, and each track means includes an upper rearwardly extending closed-end part 74, each track thus taking the form of an inverted L.

The post in these Figs. is designated at 76 and has much the appearance of the post 24 but in this case a cross pin 78 projects at its opposite ends (FIG. 9) to provide followers that ride in the tracks 72–74, as best seen in full lines in FIG. 7, wherein the post is in its down position and the pin 78 is in the upper parts of the track. The side walls 64 are provided with apertures for selectively receiving a stop pin 80 to enable adjustment of the post to accommodate the rake angle of the transom.

When the post is in its down position, it depends from the pin 78 in the top parts of the tracks and rests against the lower stop pin 80. The weight of the person climbing the ladder of course prevents the post from shifting forwardly in the top track portions. However, with this weight removed, the post may be swung rearwardly and then upwardly to an inverted position and then shifted forwardly for descent into the pocket 68 where it is confined between the cross wall 6 and the transom so that it cannot be accidently dislodged (broken lines FIG. 7). The steps (not shown) may be the same as those previously described.

FIG. 1A shows the ladder mounted on the transom of an inflatable boat 12*a*. The ladder is relatively small and is easily mountable in the limited space available on such craft, especially since a ladder could not be conveniently mounted on the gunwales.

All forms of the invention provide a simple, inexpensive ladder which is positively positionable for use and storage. The combined pin and slot or track and follower means makes for an easily operable lock and unlock means. Features and advantages other than those enumerated will appear to those versed in the art, as will many modifications of the preferred embodiments set forth herein.

I claim:

1. A ladder for attachment to the transom of a small boat, comprising a bracket of general U-shape as seen from above and including a transverse substantially upright wall including means for affixation of the bracket to the transom and a pair of upright, fore-and-aft flanges spaced closely laterally apart and rigid with and extending rearwardly from the wall, a transverse pivot carried by and spanning the flanges, a ladder post having a free end portion received between the flanges and having means connecting said end portion to the pivot for swinging inversion of the post from a down position extending into the water and an up position clear of the water, said means including a track extending lengthwise of the end portion and receiving the pivot as a track follower, said track having a first stop closely adjacent to the terminal end of the post and a second stop relatively remote from said terminal end, whereby the post in its down position depends from the pivot via its first stop and in its up position slides downwardly in the track and engages the second stop so that the portion of the post between the stops engages the bracket wall below the pivot to retain the post generally upright and against rearward swinging until the post is manually lifted upwardly to engage the first stop with the pivot.

2. The ladder of claim 1, including means cooperative between the post and the bracket for limiting forward swinging of the post about the pivot in its down position, said means being selectively adjustable to change the angle of the depending post relative to the transom.

* * * * *